US009980320B2

(12) United States Patent
Eng

(10) Patent No.: US 9,980,320 B2
(45) Date of Patent: May 22, 2018

(54) METHOD OF OPTIMIZING USE OF COOKTOP AND COOKTOP WITH OPTIMIZATION

(71) Applicant: BSH Home Appliances Corporation, Irvine, CA (US)

(72) Inventor: Lindsay Eng, Long Beach, CA (US)

(73) Assignee: BSH Home Appliances Corporation, Irvine, CA (US)

( * ) Notice: Subject to any disclaimer, the term of this patent is extended or adjusted under 35 U.S.C. 154(b) by 882 days.

(21) Appl. No.: 14/019,619

(22) Filed: Sep. 6, 2013

(65) Prior Publication Data

US 2015/0069048 A1 Mar. 12, 2015

(51) Int. Cl.
*H05B 6/06* (2006.01)
*H05B 1/02* (2006.01)

(52) U.S. Cl.
CPC ..... *H05B 1/0266* (2013.01); *H05B 6/062* (2013.01); *H05B 2213/05* (2013.01)

(58) Field of Classification Search
CPC .... H05B 1/0263; H05B 1/0266; H05B 6/065; H05B 6/1209; H05B 2213/03; H05B 2213/05
USPC ..... 219/445.1, 622
See application file for complete search history.

(56) References Cited

U.S. PATENT DOCUMENTS 6,930,287 B2 * 8/2005 Gerola ..... H05B 3/746 219/446.1
2009/0258331 A1 * 10/2009 Do ..... G09B 21/003 434/127
2012/0228282 A1 * 9/2012 Schroeder ..... H05B 6/1245 219/445.1
2012/0321761 A1 * 12/2012 De la Cuerda Ortin ..... H05B 6/062 426/231

FOREIGN PATENT DOCUMENTS

DE 102011087216 A1 5/2013

OTHER PUBLICATIONS

Pigeon; Pigeon Induction Cooktop Rapido Eco; Online: Shopping.IndiaTimes.com; Accessed Aug. 2, 2013.
Belair Living; BCC070 70cm Frameless Electronic Ceran Cooktop with Knob Control; Online: BelairLiving.com.au; Dec. 2010.
Teka Group; Teka IRS 943 Induction Hob; Online: Teka.com; Publication 2013.

(Continued)

*Primary Examiner* — Brian Jennison
(74) *Attorney, Agent, or Firm* — Michael E. Tschupp; Andre Pallapies; Brandon G. Braun

(57) ABSTRACT

A method of optimizing performance of a cooktop with a plurality of adjacent heating zones includes indicating a point for each heating zone; placing a cooking vessel on the cooktop, the cooking vessel being sufficiently large to cover at least two of the points simultaneously; and adjusting the cooking vessel so that the cooking vessel covers the maximum number of the points possible for the size of the (Continued)

cooking vessel. A cooktop includes at least three induction heating elements; and a persistent indicator for each heating element. The cooktop is adapted to instruct a user to cover a maximum possible number of the at least three persistent indicators with a cooking vessel to optimize use of the cooktop.

12 Claims, 4 Drawing Sheets

(56) References Cited

OTHER PUBLICATIONS

Asko; HI1683G 64 cm Induction Hob with Adaptive Zone and Auto Programs; Online: ASKO.co.nz; Accessed Aug. 2, 2013.
Whirlpool Corporation; 6th Sense Induction Hobs; Online: Whirlpool.co.uk; Accessed Aug. 1, 2013.
Electrolux; Electrolux EHL6740FOK Hob; Online: Electrolux.co.uk; Accessed Aug. 1, 2013.
AEG; AEG HC452400EB Induction Hob; Online: AEG.co.uk; Publication 2011.
BSH Home Appliances, Ltd.; Neff T51T55X2 Induction Hob; Online: Neff.co.uk; Publication 2013.
Siemens-Electrogerate GmbH; iQ 700 EH601MV17E Instruction Manual; Onlie: Siemens-Home.co.uk, Accessed Aug. 1, 2013.

* cited by examiner

FIG. 3
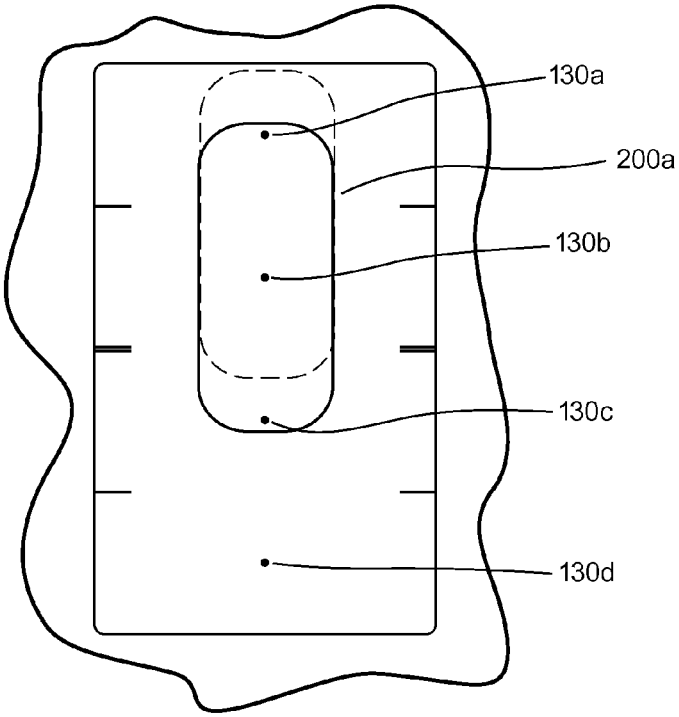
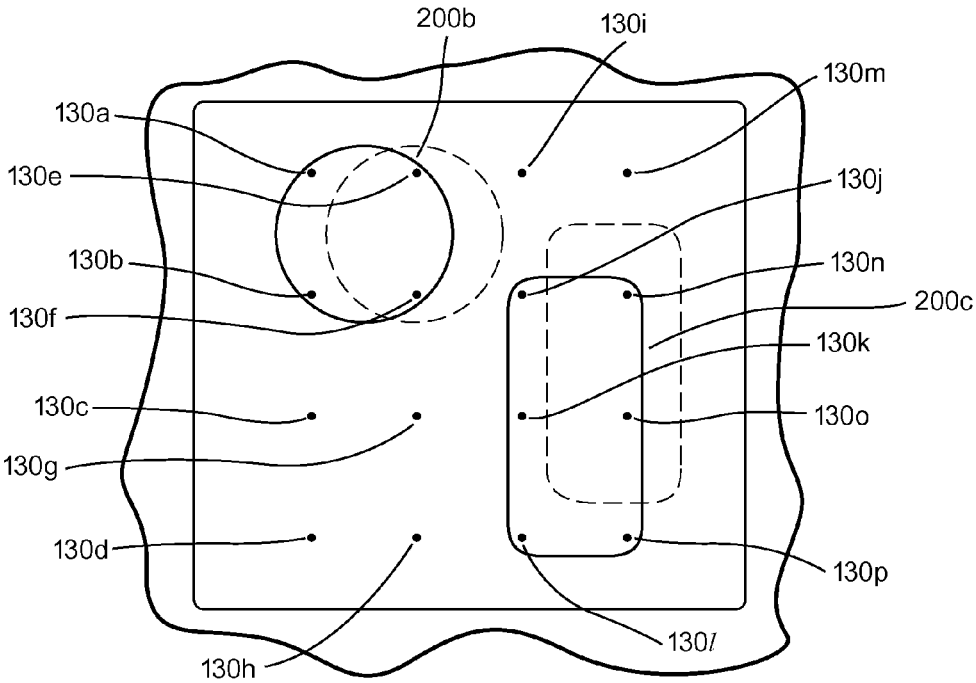
FIG. 4

METHOD OF OPTIMIZING USE OF COOKTOP AND COOKTOP WITH OPTIMIZATION

FIELD OF THE TECHNOLOGY

The present technology relates to a method of optimizing performance and associated cooking appliance. More particularly, the present technology relates to a method of optimizing performance of a cooktop including a plurality of adjacent heating zones.

BACKGROUND

In the modern kitchen, one common appliance is a cooktop, which may be a stand-alone unit or part of a larger appliance such as a stove. Most cooktops include multiple heating units, and some heating units are designed to be used in conjunction with one another to heat a single cooking vessel large enough to span multiple heating units.

The heating units can employ any known method of heating such as burners, resistive heaters and inductive heaters.

BRIEF SUMMARY

Although cooktops with heating units used in conjunction with one another are known, there is a problem in that there is not a way for the user to efficiently and knowingly optimize use of multiple heating units, especially considering cooking vessels take on a number of different sizes and shapes. Also, known cooktops do not provide instructions for users to optimize the use of multiple heating units.

In fact, some user manuals for commercial cooktops include instructions that can lead a user away from efficient use of the cooktops. For example, some user manuals instruct that cooking vessels should be placed as close to the back edge of a cooktop as possible, while still remaining on the cooking unit. Although such instructions may address safety concerns, such as providing a cooking environment where cooking vessels are less likely to be knocked off of the cooktop and result in serious injury, such instructions can result in inefficient use of the heating units. This may be of particular relevance for electric heating units generally, and more relevant to induction heating units.

For example, with induction heating units, a plurality of induction heating units can be used together with a single cooking vessel, but if the cooking vessel does not cover the induction heating units in an efficient manner, one or more of the heating units may be wasting energy, the cooking vessel may be unevenly heated, or both.

Thus, a need has developed to address one or more shortcomings of the prior art.

The present technology addresses one or more the shortcomings of the prior art.

An aspect of the present technology includes a method of optimizing performance of a cooktop by providing targets on the cooktop and adjusting a cooking vessel based on the targets.

An aspect of the present technology includes a method of optimizing performance of a cooktop including a plurality of adjacent heating zones, the method comprising indicating a point for each heating zone; placing a cooking vessel on the cooktop, the cooking vessel being sufficiently large to cover at least two of the points simultaneously; and adjusting the cooking vessel so that the cooking vessel covers the maximum number of the points possible for the size of the cooking vessel.

In examples, (a) the plurality of adjacent heating zones includes at least three heating zones, (b) the plurality of adjacent heating zones consists of four heating zones, (c) the size of the cooking vessel can cover at least three of the points simultaneously, (d) the size of the cooking vessel cannot cover each of the points simultaneously, (e) the size of the cooking vessel can cover at least three of the points simultaneously and the size of the cooking vessel cannot cover each of the points simultaneously, (f) each heating zone is a separate induction heater, (g) each point corresponds to a respective center of each of the heating zones, (h) the points all lie on a common line, (i) the points lie in at least two columns and at least two rows, (j) the points are indicated persistently, (k) the points are indicated by way of non-transient marks, (l) the heating zones are oblong and the elongate dimensions of the heating zones are substantially parallel to one another, (m) the method further comprises heating the cooking vessel with each heating zone for which the point is covered by the cooking vessel, and/or (n) the method further comprises providing an indication to adjust the cooking vessel to cover an additional point based on a known distance between points and a sensed size of the cooking vessel.

Another aspect of the present technology includes a cooktop comprising at least three induction heating elements; and a persistent indicator for each heating element; wherein the cooktop is adapted to instruct a user to cover a maximum possible number of the at least three persistent indicators with a cooking vessel to optimize use of the cooktop.

In examples, (a) the persistent indicator is a dot, (b) the persistent indicator corresponds to a respective center of each heating element, (c) the cooktop is adapted to instruct the user by way of persistent instructions attached to the cooktop, (d) the cooktop is adapted to instruct the user by way of a display, and/or (e) the cooktop further comprises a visual indicator adapted to instruct the user to cover another persistent indicator based on a known distance between the persistent indicators and a sensed size of the cooking vessel.

Other aspects, features, and advantages of this technology will become apparent from the following detailed description when taken in conjunction with the accompanying drawings, which are a part of this disclosure and which illustrate, by way of example, principles of this technology.

BRIEF DESCRIPTION OF THE DRAWINGS

FIG. 3 illustrates a first schematic diagram in accordance with the present technology;

FIG. 4 illustrates a second schematic diagram in accordance with the present technology; and .

DETAILED DESCRIPTION

The following description is provided in relation to several examples which may share common characteristics and features. It is to be understood that one or more features of any one example may be combinable with one or more features of the other examples. In addition, any single feature or combination of features in any of the examples may constitute additional examples.

Throughout this disclosure, terms such as first, second, third, etc. may be used. However, these terms are not intended to be limiting or indicative of a specific order, but instead are used to distinguish similarly described features from one another, unless expressly noted otherwise. Terms such as substantially and about are intended to allow for variances to account for manufacturing tolerances, measurement tolerances, or variations from ideal values that would be accepted by those skilled in the art.

As used throughout this disclosure, heating zones refer to a location on a cooktop used for heating and the heating zones may be any convenient shape, e.g. circular or rectangular. Each heating zone may comprise one heating element or more. As used throughout the disclosure, heating element may refer to the physical components that generate heat as well as their corresponding location within a heating zone.

Figure 1:
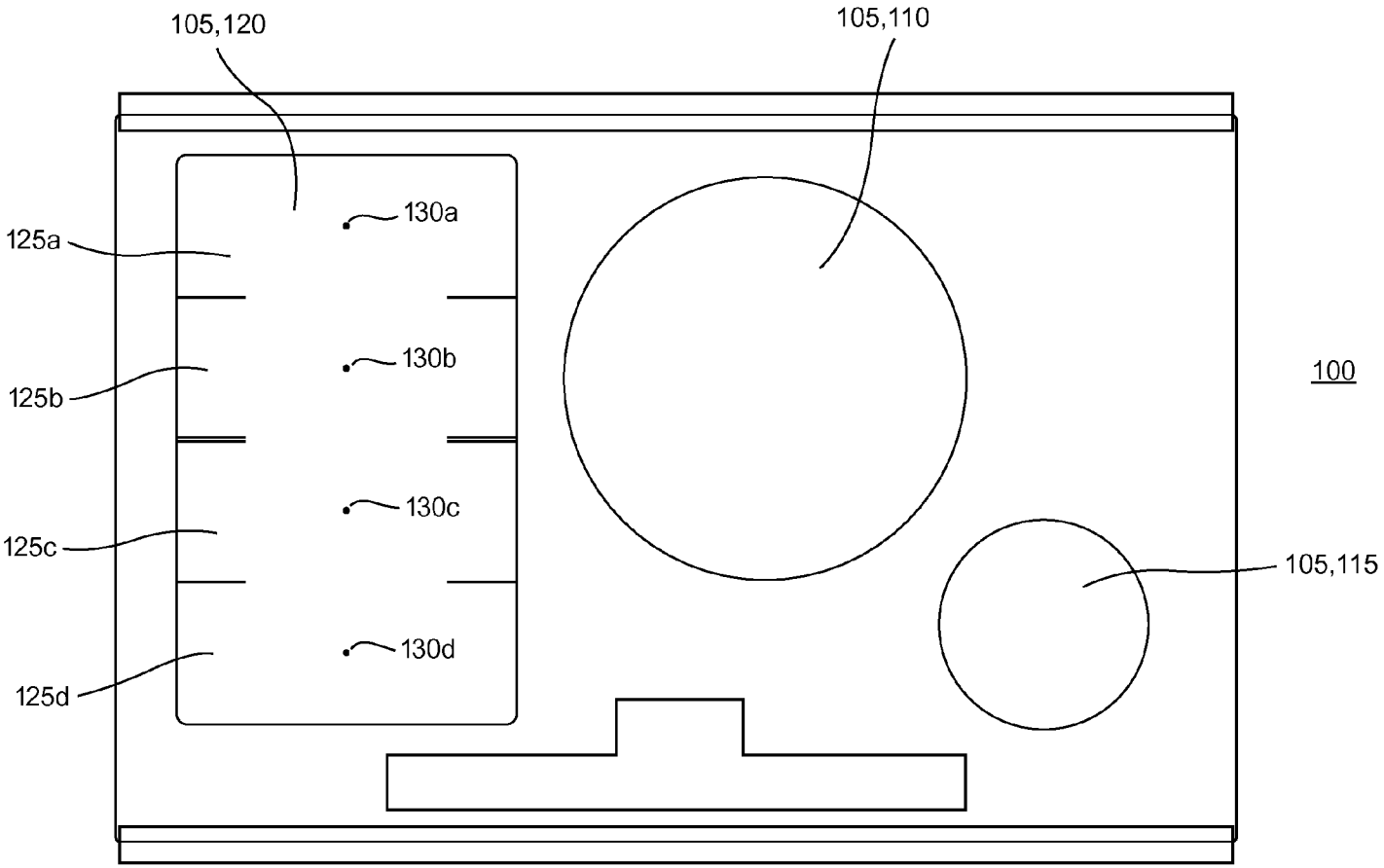
FIG. 1 illustrates a first cooktop in accordance with the present technology.
Figure 2:
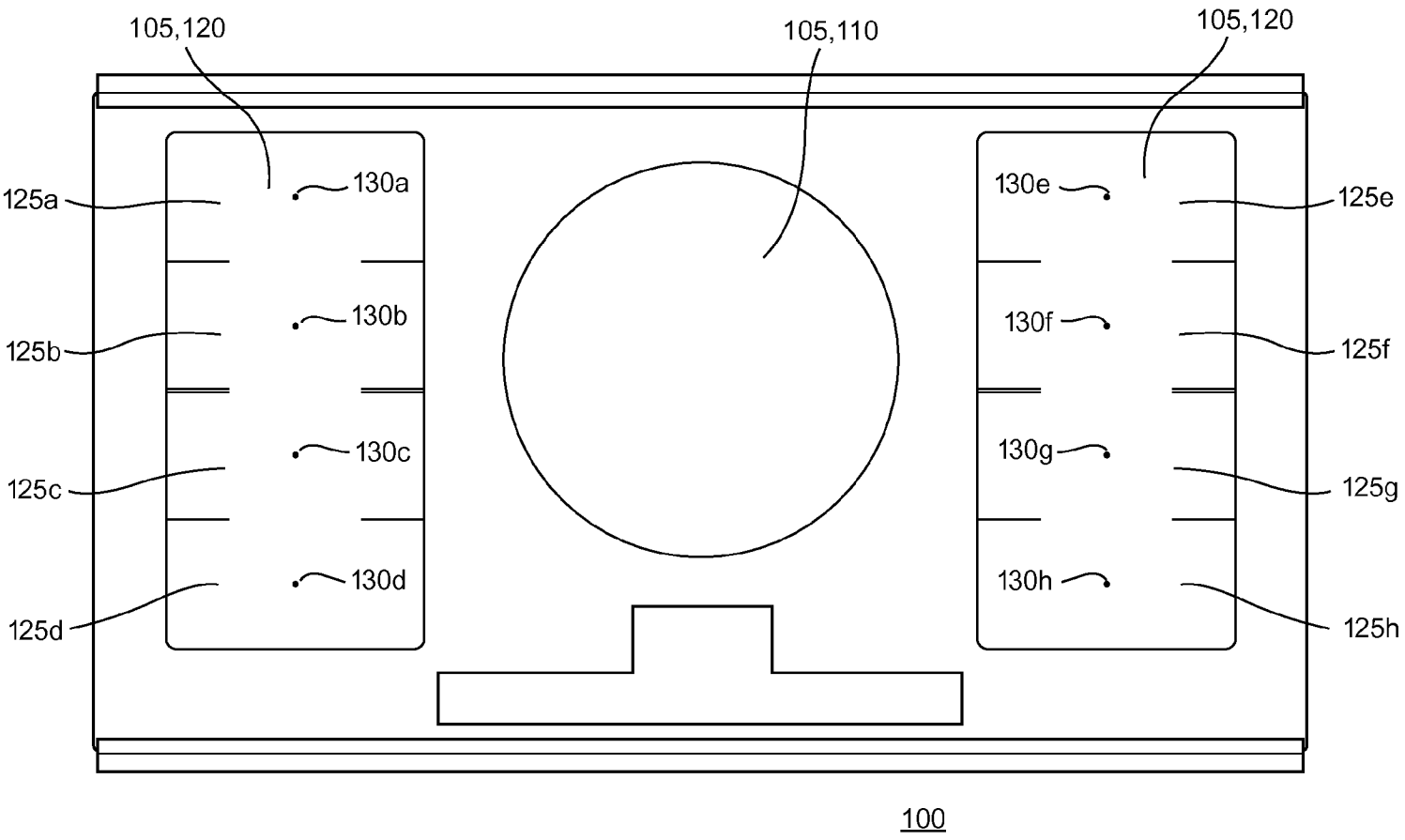
FIG. 2 illustrates a second cooktop in accordance with the present technology.
Figure 5:
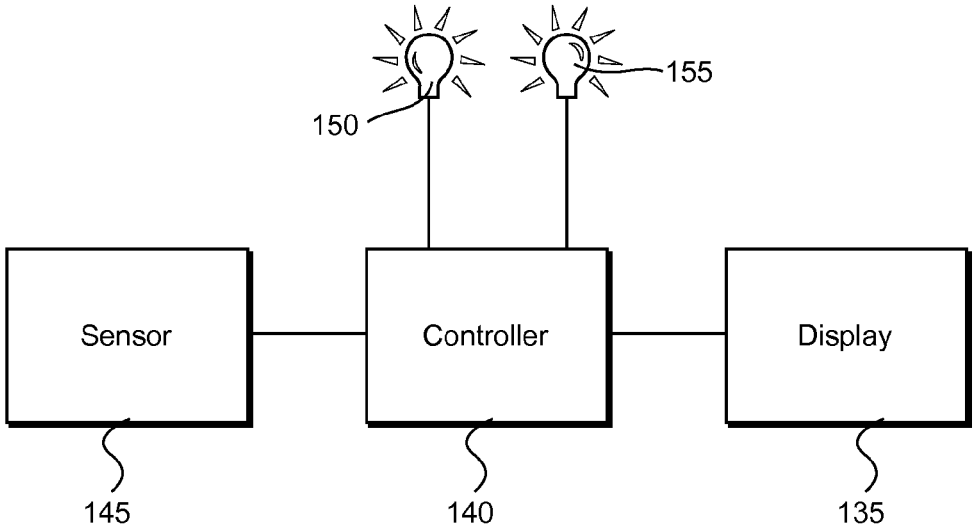
FIG. 5 illustrates a control diagram in accordance with the present technology.

FIGS. 1 and 2 both illustrate a cooktop 100 that include many common components. The cooktop 100 may include a number of heating zones 105, which may be round heating zones 110, 115 or rectangular heating zones 120. The rectangular heating zones 120 may include a plurality of heating elements 125*a*-125*d*, generally adjacent to one another, which together define the rectangular heating zone 120. FIG. 1 illustrates one group four of heating elements 125*a*-125*d* forming a rectangular heating zone 120 and FIG. 2 illustrates two groups of four heating elements 125*a*-125*d* and 125*e*-125*h* forming two rectangular heating zones 120. The heating elements 125 may be any type of heating element, e.g., an electrical heating element. In a non-limiting example, the heating elements 125 are induction heating elements.

The heating elements 125 may be any convenient shape. The configurations in FIGS. 1 and 2 are illustrated as oblong. The cooktop 100 includes outlines on the cooking surface that are generally rectangular, but under the surface of the cooktop 100, the heating elements 125 may include any shape, e.g. oval or elliptical heating elements. As illustrated, the heating elements 125 are oriented such that their elongate dimensions are substantially parallel to one another. As will be appreciated by those of ordinary skill, the cooktop 100 may include one continuous sheet of glass or ceramic, with indicators, e.g. printed outlines, to designate locations of the heating zones 105 where the heating elements 125 are located under the continuous sheet.

Heating elements 125 may include an indicator 130. The indicator 130 may be any suitable indicator, e.g. a printed mark such as a dot or an illuminated mark, which may be persistent and/or non-transient. The indicator 130 preferably is located to indicate a location of the heating element 125 that should be covered by a cooking vessel 200 in order to achieve optimum performance of the cooktop 100. As illustrated in FIGS. 1 and 2, the indicators 130*a*-130*h* are at a location on the surface of the cooktop 100 corresponding to a center of a respective heating element 125*a*-125*h*.

FIGS. 3 and 4 are schematic illustrations of indicators 130 and cooking vessel 200*a*. FIG. 3 corresponds generally to the rectangular heating zones 120 of FIGS. 1 and 2 where the indicators 130 lie on a common line. FIG. 4 illustrates indicators 130 and cooking vessels 200*b*, 200*c* in a more abstract manner where the indicators 130 are distributed in rows and columns. Of course, other configurations of indicators 130 are possible, e.g. alternately offset rows and columns where indicators in one line are offset vertically and/or horizontally with respect to an adjacent line, which will be dictated by the configuration of heating zones 105 and heating elements 125 for a given cooktop 100.

In FIG. 3, the cooking vessel 200*a* is illustrated with dashed lines in a location that is not optimized and with a solid line that is optimized. The dashed-line position illustrates the cooking vessel 200*a* towards a top or "rear" edge of the cooktop 100. This position corresponds to a position taught in certain prior art devices, presumably for safety. However, this position does not allow optimum performance of the cooktop 100 for the cooking vessel 200*a*. The solid-line position spans three indicators 130*a*-130*c*. But as can be readily discerned from FIG. 3, the cooking vessel 200*a* cannot span more than three indicators 130. Thus, the cooking vessel 200 is located in an optimized position according to the present technology. Moving the cooking vessel 200*a* from the dashed-line position to the solid-line position will adjust the cooking vessel 200*a* so that the cooking vessel 200*a* covers the maximum number of indicators 130 possible for the size of the cooking vessel 200*a*. This technique can be applied to any combination of three or more indicators 130 and a cooking vessel 200 that spans two or more indicators 130. The indicators 130 may help a user to appropriately position, e.g. center, a cooking vessel 200 to achieved optimum effect of the cooktop 100. Once the cooking vessel 200 is located to achieve the optimum effect, the cooking vessel can be heated (optimally) by each heating element 120 with a correspondingly covered indicator 130. Alternatively, this technique can be applied to any number of indicators 130. For example, this technique can also be applied to one, two, three or four indicators 130 (as illustrated in FIGS. 1-3) with a cooking vessel 200 that covers, e.g. is centered on, anywhere from one to four indicators 130.

The cooktop 100 may also be configured such that covering an indicator 130 with a cooking vessel 200 will activate the corresponding heating element 125. Similarly, the cooktop 100 may be configured such that if an indicator 130 is not covered with a cooking vessel 200, the corresponding heating element 125 will not activate even if the cooking vessel 200 covers another part of the heating element 125.

FIG. 4 illustrates rows and columns of indicators 130 and two alternate configurations of the cooking vessel 200.

Cooking vessel 200*b* is illustrated as generally round. Similar to FIG. 3 above, the dashed-line position of the cooking vessel 200*b* is not optimized in accordance with the present technology whereas the solid-line position is optimized in accordance with the present technology. The dashed-line position encompasses only two indicators 130*e* and 130*f*, whereas the solid-line position encompasses four indicators 130*a*, 130*b*, 130*e* and 130*f*. There is not another position where the cooking vessel 200*b* can cover more of the indicators 130. Thus, the solid-line location is optimized.

Cooking vessel 200*c* is illustrated as generally rectangular. As discussed above, the dashed-line position is not optimized in accordance with the present technology, whereas the solid-line position is optimized in accordance with the present technology.

Any shape of cooking vessel 200 can be used in accordance with the present technology. In fact, the shape of the cooking vessel 200 does not affect the present technology except in that different sizes and shapes will be able to cover different configurations of indicators 130. The shapes of the cooking vessel 200 illustrated in FIGS. 3 and 4 were chosen for ease of illustration only and should not be considered limiting.

The cooktop 100 may include instructions for a user to optimize use of the cooktop 100. The instructions could be in the form of a placard, illustration or other fixed media attached to the cooktop 100. The instructions could be in the form of diagrams similar to FIGS. 3 and 4 or in the form of written instructions. The cooktop 100 could also include an electronic display 135 with animations driven by an associated controller 140 to actively illustrate how to achieve the optimization in accordance with the present technology.

The cooktop 100 may also include a sensor 145 using known sensing technology that allows the cooktop 100 to determine a size and a location of the cooking vessel 200. U.S. Patent Application Publication No. 2012/0321761 discloses a method and device to determine a size and location of a cooking vessel and is incorporated herein by reference in its entirety. The cooktop 100 can, based upon the determination of size and location, provide an indication to a user to move the cooking vessel 200 to optimize the location. The indication could include a binary indication such as a red light 150 indicating that or when the cooking vessel 200 is not placed optimally and a green light 155 indicating that or when the cooking vessel 200 is placed optimally. The indication could also include an electronic display 135 with or without animation indicating how to optimize the location of the cooking vessel 200.

While the present technology has been described in connection with several practical examples, it is to be understood that the technology is not to be limited to the disclosed examples, but on the contrary, is intended to cover various modifications and equivalent arrangements included within the spirit and scope of the technology.

What is claimed is:

1. A cooktop comprising:

at least three induction heating elements;

a persistent indicator for each heating element located at a point that corresponds to a respective point at the center of each heating element;

one or more sensors operable to determine a size and a location of a cooking vessel; and an electronic display operable to instruct a user to cover a maximum possible number of the at least three persistent indicators with the cooking vessel to optimize use of the cooktop, wherein when the one or more sensors determines that the location of the cooking vessel is not optimized, the electronic display instructs the user to move the cooking vessel to optimize use of the cooktop.

2. The cooktop according to claim 1, wherein the persistent indicator is a dot.

3. The cooktop according to claim 1, further comprising outlines on a cooking surface corresponding to each heating element, wherein the persistent indicator is at the center of the corresponding outline.

4. A cooktop comprising:

at least three induction heating elements;

a glass cooking surface;

a plurality of persistent indicators, each formed on the glass cooking surface and corresponding to a respective one of the at least three induction heating elements, wherein the plurality of persistent indicators being located at a point above a center of the corresponding heating element;

one or more sensors operable to determine a size and a location of a cooking vessel; and an electronic display configured to display instructions to a user to cover a maximum possible number of the at least three persistent indicators with a cooking vessel to optimize use of the cooktop, wherein when the one or more sensors determines that the location of the cooking vessel is not optimized, the electronic display instructs the user to move the cooking vessel to optimize use of the cooktop.

5. The cooktop according to claim 4, wherein the persistent indicator is a dot.

6. The cooktop according to claim 4, further comprising outlines on a cooking surface corresponding to each heating element, wherein the persistent indicator is at the center of the corresponding outline.

7. The cooktop according to claim 4, wherein the electronic display, based on the determinations of the sensor, provides an animation indicating how to move the cooking vessel to optimize the location of the cooking vessel.

8. A cooktop comprising:

at least three induction heating elements;

a persistent indicator for each heating element located at a point that corresponds to a respective point at the center of each heating element;

one or more sensors operable to determine a size and a location of a cooking vessel; and a visual indicator operable to instruct a user to cover a maximum possible number of the at least three persistent indicators with the cooking vessel to optimize use of the cooktop, wherein when the one or more sensors determines that the location of the cooking vessel is not optimized, the visual indicator instructs the user to move the cooking vessel to optimize use of the cooktop.

9. The cooktop according to claim 7, wherein the visual indicator is operable to instruct the user to cover another persistent indicator based on a known distance between the persistent indicators and a sensed size of the cooking vessel.

10. The cooktop according to claim 4, wherein the persistent indicator is a dot.

11. The cooktop according to claim 4, further comprising outlines on a cooking surface corresponding to each heating element, wherein the persistent indicator is at the center of the corresponding outline.

12. The cooktop according to claim 1, wherein the electronic display, based on the determinations of the sensor, provides an animation indicating how to move the cooking vessel to optimize the location of the cooking vessel.

* * * * *